United States Patent [19]

Monroe

[11] Patent Number: 4,911,866

[45] Date of Patent: Mar. 27, 1990

[54] FOG PRODUCING APPARATUS

[75] Inventor: Marshall M. Monroe, Glendale, Calif.

[73] Assignee: The Walt Disney Company, Burbank, Calif.

[21] Appl. No.: 276,240

[22] Filed: Nov. 25, 1988

[51] Int. Cl.[4] ..... B01F 3/04

[52] U.S. Cl. ..... 261/81; 261/120; 261/DIG. 48; 239/102.2

[58] Field of Search ..... 239/102.2; 261/DIG. 48, 261/81, 120

[56] References Cited

U.S. PATENT DOCUMENTS

| | | | |
|---|---|---|---|
| 3,561,444 | 2/1971 | Boucher | 261/DIG. 48 |
| 3,690,317 | 9/1972 | Millman | 261/DIG. 48 |
| 3,892,235 | 7/1975 | Amerongen et al. | 261/DIG. 48 |
| 4,001,077 | 1/1977 | Kemper | 261/120 |
| 4,308,137 | 12/1981 | Freeman | 261/120 |
| 4,530,464 | 7/1985 | Yamamoto et al. | 239/102.2 |
| 4,550,325 | 10/1985 | Viola | 239/102.2 |
| 4,641,053 | 2/1987 | Takeda | 261/DIG. 48 |
| 4,746,466 | 5/1988 | Takahashi | 261/DIG. 48 |
| 4,776,990 | 10/1988 | Verity | 261/DIG. 48 |

FOREIGN PATENT DOCUMENTS

| | | | |
|---|---|---|---|
| 0053514 | 4/1977 | Japan | 261/DIG. 48 |
| 91414 | 8/1978 | Japan | 239/102.2 |

*Primary Examiner*—Tim Miles

*Attorney, Agent, or Firm*—Fulwider, Patton, Reiber, Lee & Utecht

[57] ABSTRACT

A fog producing apparatus for suspending fine particles of water in air in an economical and reliable manner. Ultrasonic transducers potted in an electrically insulative and liquidproof material are placed in a container in which a predetermined water level is maintained by a float and valve device. Alternatively, the potted transducers are suspended below floats floating on the surface of the water whereby the critical water depth over the transducers is automatically maintained. In addition compressed air is conducted through the emanating fog plumes to provide a more homogeneous and dispersed fog effect. A copious amount of fog can thereby be efficiently and reliably produced to create theatrical or visual effects.

14 Claims, 4 Drawing Sheets

FIG. 1 PRIOR ART
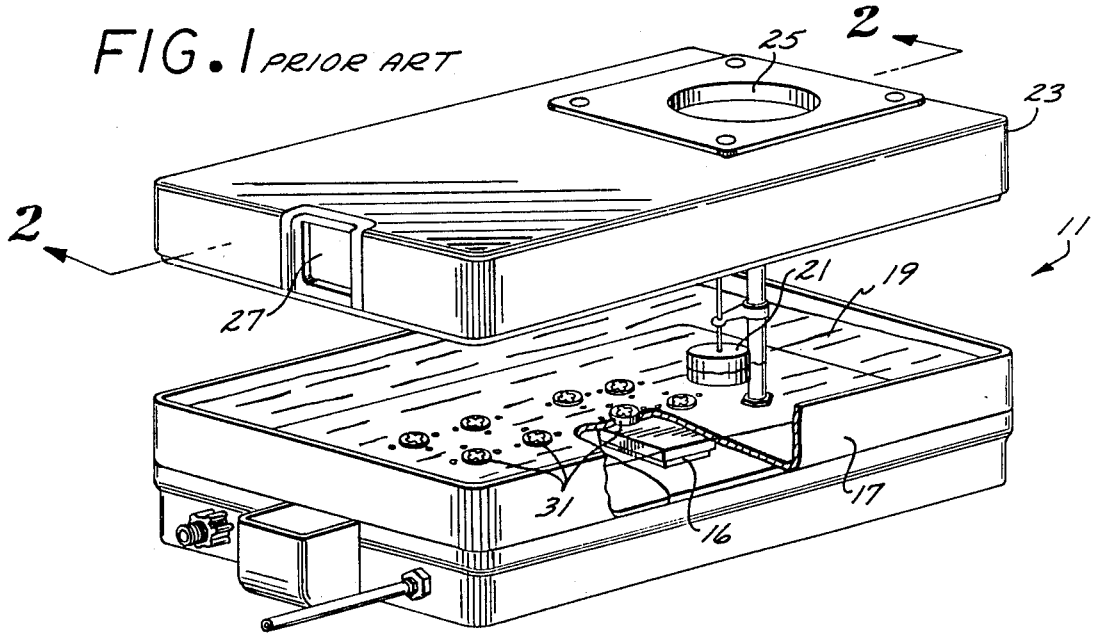
FIG. 2 PRIOR ART
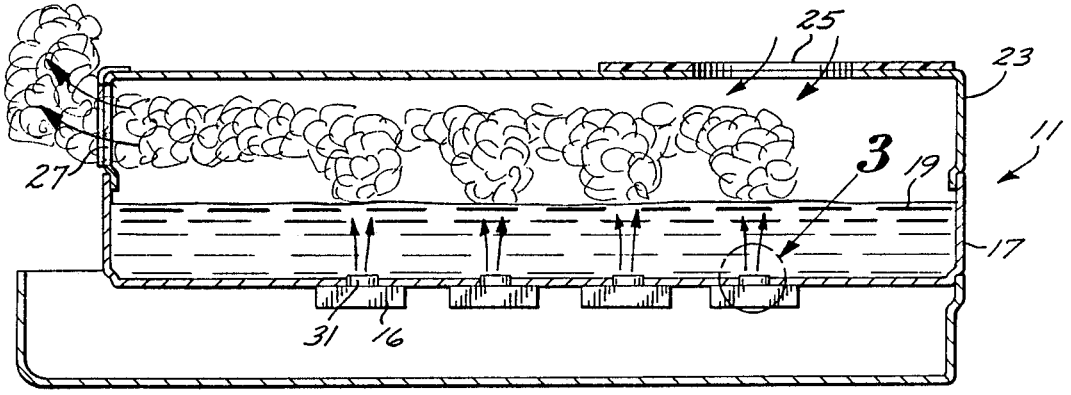
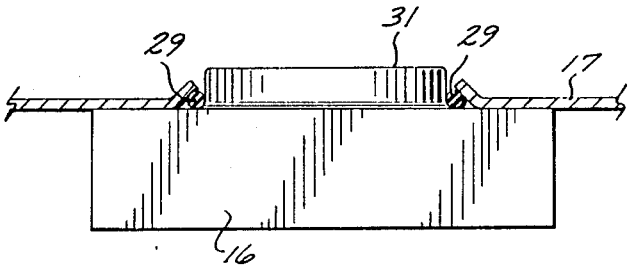
FIG. 3 PRIOR ART FIG. 4
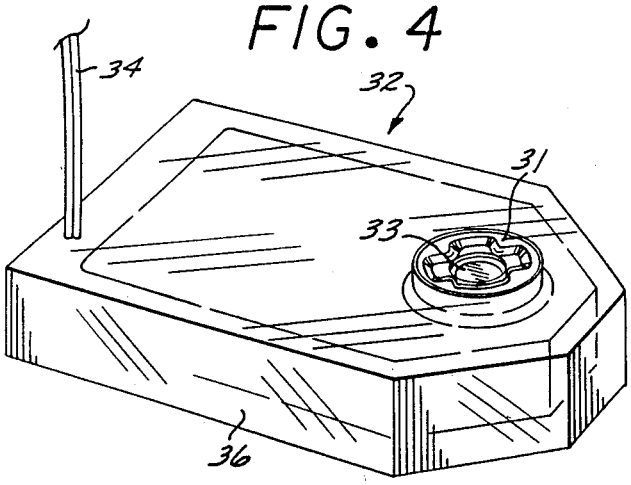
FIG. 5
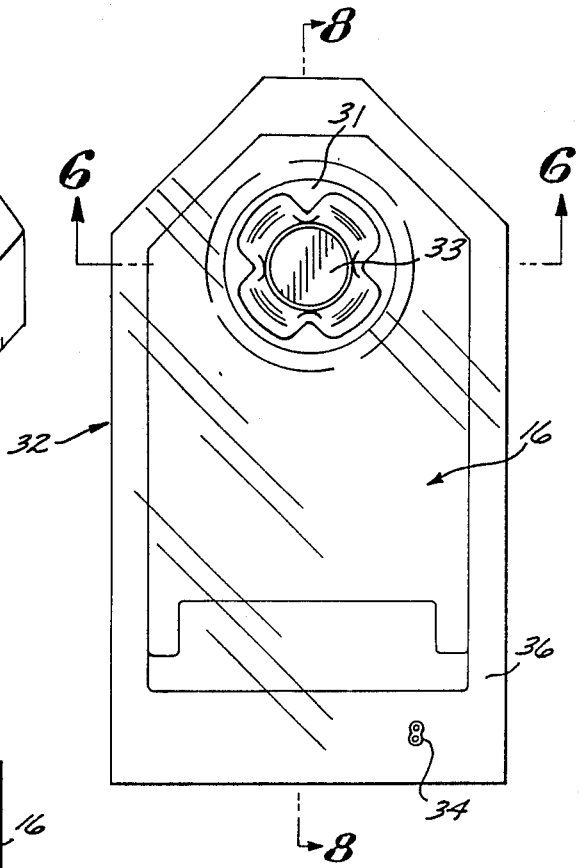
FIG. 6
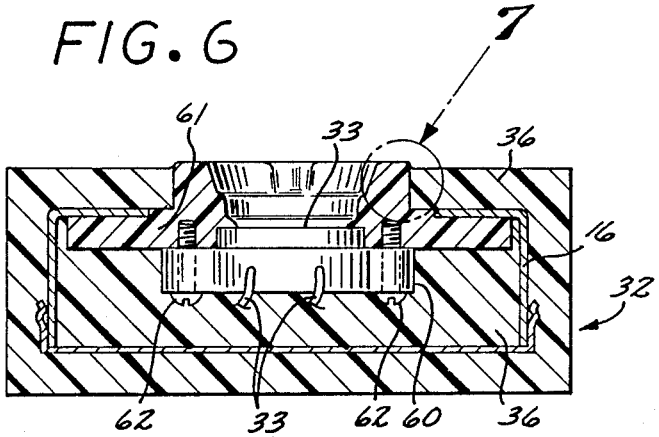
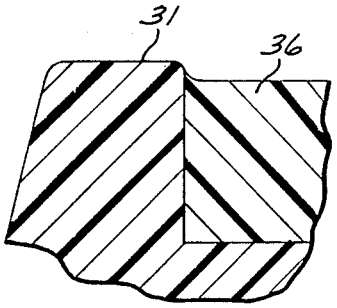
FIG. 7
FIG. 8
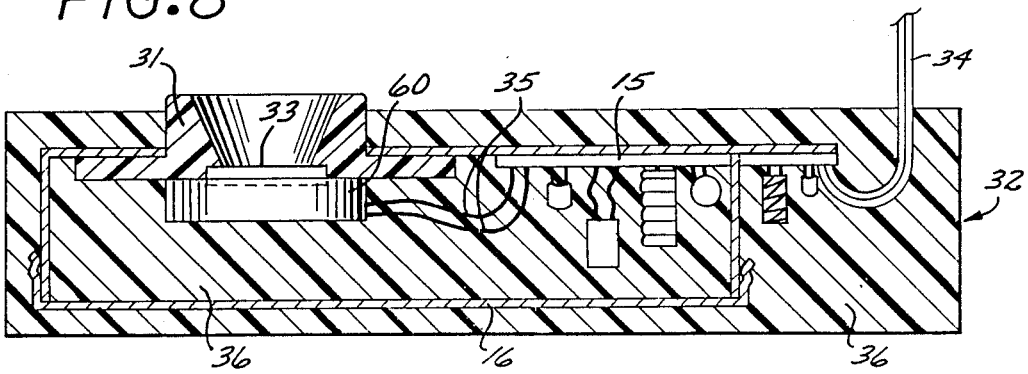

FOG PRODUCING APPARATUS

BACKGROUND OF THE INVENTION

The present invention relates to a fog-producing apparatus and more particularly pertains to a versatile, low-maintenance fog generator that can be used for a variety of applications including the creation of theatrical or visual effects.

A number of methods have heretofore been employed for suspending a finely divided liquid in a gas. Disadvantages associated with these methods limit their utility. For example, steam producing techniques consume significant amounts of energy and may pose a safety risk due to the associated elevated temperatures and pressures involved. High pressure nozzle systems use a combination of low pressure liquid and high pressure gas to generate a large particle mist. Substantial volumes of compressed gas are required and the typically high muzzle velocities can pose a danger. In addition, the small diameter nozzles clog easily and thereby compromise the performance of such a system. Cryogenics (i.e. liquid nitrogen and liquid carbon dioxide) can be dangerous to handle and are prohibitively expensive.

When only the appearance of fog or mist is required so as to produce theatrical or visual effects, additional methods are applicable as for example the combustion of a smoke-producing material, the use of a chemical fog or the suspension of solid particulates in the atmosphere. Significant disadvantages are associated with each of these methods when used in a theatrical environment especially when the effect is to be maintained or continually repeated over an extended period of time. Combustion invariably requires heat and flame, emits potentially hazardous combustion products and consumes the combustible material. Chemical fog typically has a distinct odor, leaves an oily residue behind and is of significant cost. Solid particulates, such as for example finely divided flour leaves a messy residue and is relatively expensive. In addition, the previously mentioned steam producing technique can quickly raise the ambient temperature and humidity of a theatrical set to uncomfortable levels, while the cyrogenics approach, due to the cold gases' inherent densities, may not provide quite the desired effect.

An alternative approach devoid of the disadvantages listed above employs an ultrasonic transducer. Such a device consists of a ceramic, stainless steel coated disk which is caused to oscillate in the MHz frequency range by an electric signal generated by associated electronic circuitry. The resulting high frequency shock waves produced by the transducer are transferred through the liquid with which the transducer is in contact to the gas/liquid interface where the intermolecular bonds of the liquid are mechanically overcome. Atomization of the liquid is thereby accomplished as the molecules are ejected in small clusters and become suspended in the gas. Such a device when adapted for use within water produces a true fog devoid of odor, poses no health or safety hazard, does not present residue or contamination problems, does not significantly affect the ambient temperature of its environment and is capable of producing substantial volumes of fog or mist at a very modest cost. Such transducers are adaptable for use in any non-viscous liquid.

The major disadvantages and shortcomings associated with the use of MHz transducers to produce a mist or a fog have heretofore related to the leakage of liquid into sensitive areas of the transducer and its associated circuitry in addition to problems associated with effectively maintaining the critical liquid level above the transducer disk. Given a certain disk size, power output and operating frequency of a particular ultrasonic transducer determines the optimum depth of liquid that needs to be maintained over the transducer to maximize the fog output of such a device. This requirement has typically been filled in a relatively complex manner by disposing the transducer beneath a body of liquid and maintaining a predetermined liquid level thereabove with a float and valve arrangement.

SUMMARY OF THE INVENTION

The general purpose of the invention is to provide a fog producing apparatus that is capable of producing significant amounts of fog, is not susceptible to water damage and wherein close attention to a water level is not required. To attain this, the present invention provides for the potting of an entire ultrasonic transducer module in an insulative and liquidproof material, only leaving the transducer disk exposed to the environment. Such a transducer is capable of atomizing a liquid by projecting ultrasonic energy to the surface of the liquid. The potted tranducer module can either simply be placed in a body of water, the level of which is precisely maintained or alternatively, the potted transducer can be suspended in the water from a float by which the specified depth of water above the transducer disk is thereby automatically maintained without regard to the total liquid depth of the body of water. A plurality of such devices arranged in close proximity to one or another serve to produce a substantial amount of fog. In addition, an air tube conducting a flow of air towards the fog plumes emanating from the transducers serves to break up individual plumes to yield a more dispersed and homogenous mist or fog effect.

BRIEF DESCRIPTION OF THE DRAWINGS

Other objects and many of the attendant advantages of this invention will be readily appreciated as the same becomes better understood by reference to the following details described when considered in conjunction with the drawings in which like reference numerals designate like parts throughout the figures thereof and wherein:

FIG. 1 is a partially exploded and partially cut back perspective view of a prior art fog producing apparatus;

FIG. 2 is a cross-section of FIG. 1 along lines 2—2 illustrating said apparatus in the process of producing fog;

FIG. 3 is a close up of the area indicated in FIG. 2 showing in cross-section an ultrasonic transducer disposed within the fog producing apparatus;

FIG. 4 is a perspective view of a potted ultrasonic transducer of the present invention;

FIG. 5 is a top plan view of the device shown in FIG. 4;

FIG. 6 is a cross-section of the fog producing module taken along line 6—6 of FIG. 5;

FIG. 7 is an enlarged view of the area indicated in FIG. 6;

FIG. 8 is a cross-section of the potted transducer of the present invention taken along lines 8—8 of FIG. 5;

DETAILED DESCRIPTION OF THE PREFERRED EMBODIMENTS

Figure 9:
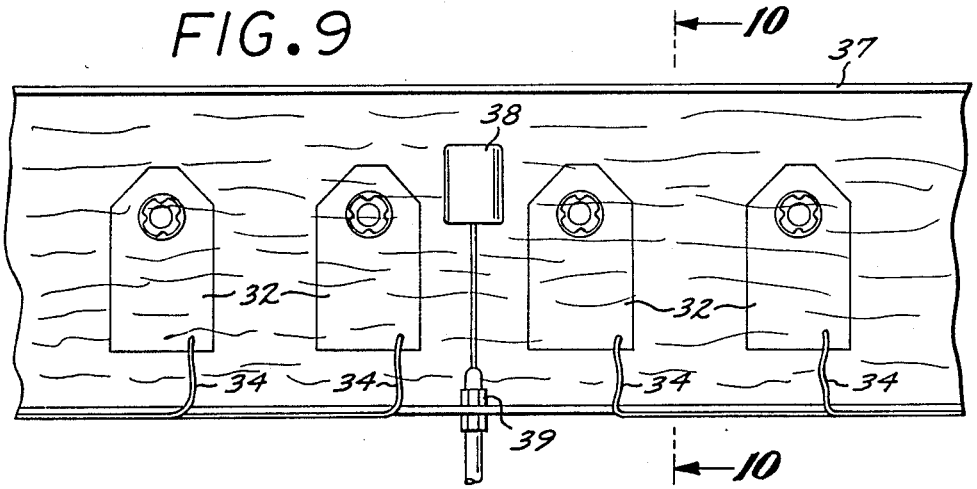
FIG. 9 is a top plan view of a series of potted transducers of the present invention disposed in a tank of water.

As previously mentioned, the object of the present invention is to provide an apparatus for producing copious amounts of fog. Ultrasonic transducers are available which are capable of ejecting small conglomerations of liquid into an atmosphere by oscillating a submerged disk in the MHz frequency. The transducer 31 generally consists of a structure housing a stainless steel coated ceramic disk 33 driven typically by piezoelectric means. Electronic circuitry 15 required to drive the oscillating disk at MHz frequencies is typically disposed in relatively close proximity to the transducer itself. Such an ultrasonic transducer and its associated electronic circuitry is substantially maintenance free with an estimated service life of approximately 10,000 hours. As was mentioned above the service life of such ultrasonic transducers is however often severely cut short by water damage to the electronic circuitry. The adaptation of such a transducer module beneath a body of liquid has emphasized the shortcomings of the heretofore used sealing methods.

The size of the oscillating disk as well as the output power and operating frequency of a specific module determines the distance by which said disk must be disposed below the surface of the liquid so as to optimize its fog-producing effect. For example, a tranducer module having an input power requirement of 30 Watts (48V AC) capable of oscillating a ¾ inch diameter disc at 1.6 MHz requires that the transducer disc be submerged under approximately 1 inch of water. A commercially available example of such a transducer module is sold under the TDK trademark and designated as "Type NB-58S". This module is a preferred component of the present invention.

FIGS. 1–3 illustrate a fog producing apparatus 11 of the prior art which suffers from the shortcomings indicated above. A plurality of ultrasonic transducers 31 are disposed on the bottom of a tray 17 containing a water. Each transducer's associated electronic circuitry within housing 16 is located beneath the tray. An O-ring 29 (FIG. 3) fitted about each transducer serves to seal off the bottom of the water containing tray 17. A float 21 and valve (not shown) arrangement maintains the required water depth within the tray. A cover 23 functions as a manifold such that air blown in through port 25 sweeps the mist plumes produced by the transducers out through outlet 27.

O-rings in this type of application have proven to be susceptible to failure. Even minor leakage onto and into electronics housing 16 will cause a transducer to malfunction. In addition, a shortcoming inherent in this design is the requirement that the entire device must be shut down and the water drained to allow replacement of even a single damaged transducer. As a result, in practice, repair is usually undertaken only when the majority of the transducers have failed resulting therefore in an extended period of service with a diminished fog output. In addition, the manner in which the required water level 19 is maintained has inherent disadvantages. The apparatus must be permanently plumbed to a water supply, the float and valve assembly requires adjustment and maintenance, the entire apparatus is substantially immovable, and, a relatively large embodiment of such a device is susceptible to wave action which alternately causes the required water level above a particular transducer to be too high or too low.

In the preferred embodiment of the present invention, the transducer, including its associated electronic circuitry, as for example TDK Type NB-58S, is potted in a material that is electrically insulative and waterproof. FIGS. 4–8 illustrate such a potted transducer module 32. The top of the transducer 31 and the transducer disc 33 remains exposed while the rest of the device is encapsulated in the potting material 36. The material is simply poured in around the appropriately masked transducer 31 and the electronic circuitry 15, which in the embodiment illustrated, is separately substantially enclosed in a perforated housing 16. As shown in FIG. 6, the transducer disk 33 is secured to a plastic transducer housing 61 by a holding member 60 secured thereto by a pair of screw type fasteners 62. A further requirement in specifying the type of potting material to be employed is that it does not expand, contract or heat up excessively during its setting or curing stage. Materials that have been found appropriate for this application include urethane, silicone and epoxy.

Figure 10:
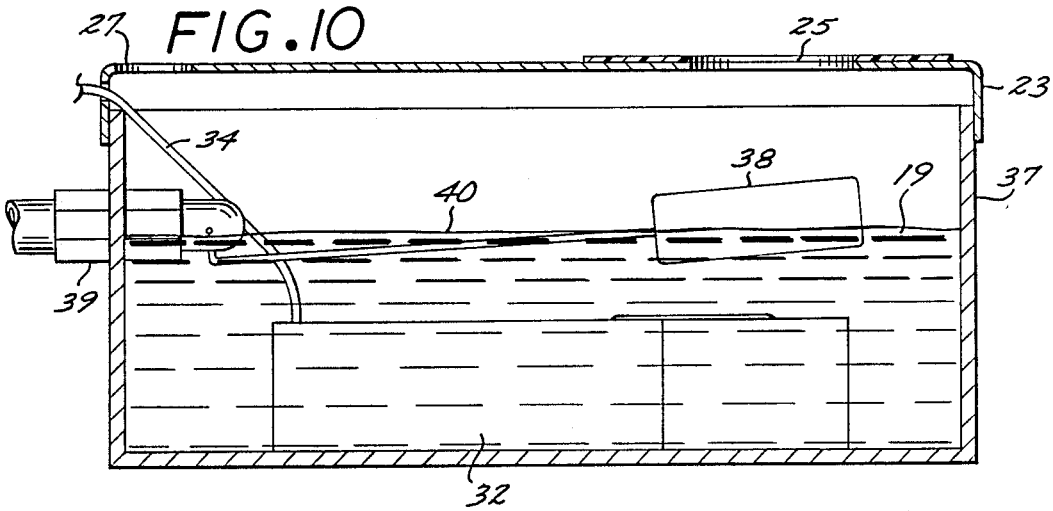
FIG. 10 is an enlarged cross-section of FIG. 9 taken along lines 10—10.

Once properly potted such a transducer module 32 or a plurality of transducer modules can be employed in a variety of ways to produce the desired misting effect. FIGS. 9 and 10 illustrate one such embodiment in which a series of transducer modules 32 are simply placed on the bottom of a water filled tray 37. The required water depth 40 is maintained via a float 38 and valve 39 arrangement. The power cords 34 extending from the modules 32 are routed so as to connect to a remote and dry power source (not shown). The float 38 gauges the water depth 40 and causes the valve 39, plumbed to a water supply (not shown), to open whenever the water drops below a predefined level and in turn causes the valve to close whenever the predefined level is once again achieved. A ducted covering 23 or manifold similar to that employed in the prior art apparatus depicted in FIGS. 1 & 2 can be utilized to collect and move the emanating mist or fog to any location desired.

In another preferred embodiment of the present invention, a plurality of potted transducer modules 32 are affixed to a floating carrier frame 42 as illustrated in FIGS. 12–15. The carrier frame 42 has provisions for accommodating one or more potted transducer modules 32 and extends upwardly for receiving float members 45. In the particular carrier frame 42 depicted in FIGS. 13–15, four cradles 41 are arranged in a cross pattern to facilitate the placement of four ultrasonic transducer modules such that the transducers are in close proximity to one another. The cradles 41 have a wall structure 50 to constrain the transducer modules therein and have a plurality of upwardly projecting arms 43 attached thereto. Each arm has a hole 46 near its distal end to accommodate a fastening means 47 by which each float member is attached. Many different fastening means are appropriate for this construction including the screw, washer and nut combination illustrated. Alternatively, a carrier frame 42 can consist of a substantially flat member sans individual cradles 41 to which the ultrasonic transducer modules 32 are affixed as by the beads of adhesive 48 illustrated in FIG. 12. A centrally located hole 52 accommodates the airpipe 51 described hereinafter. The size and density of the float members 45 is selected so as to impart a positive buoyancy to the entire apparatus, while the carrier arms 43 are configured to suspend the transducers 31 the specified distance 49 beneath the surface of the water 44. The power cords 34 are collected beneath the floating apparatus and routed to the power source (not shown). An airpipe 51 extends upwardly through the center of the device to just above the above the water level 44 and is connected at its bottom end to a compressed air source via a flexible hose (not shown). The airpipe 51 is capped with a cap 56 having holes 57 therein directed towards each transducer 31. A variety of suitable materials are available for fabricating the carrier frame 42 and the float members 45.

Figure 11:
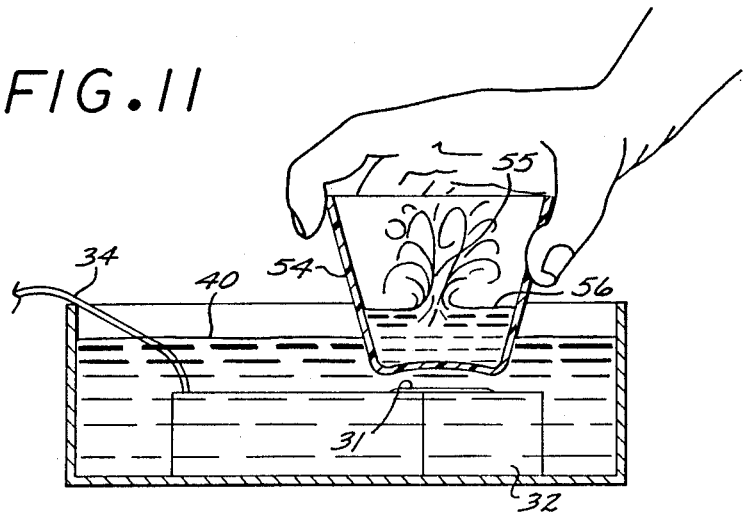
FIG. 11 is a cross-sectional view of the potted transducer being used to create a special effect.
Figure 12:
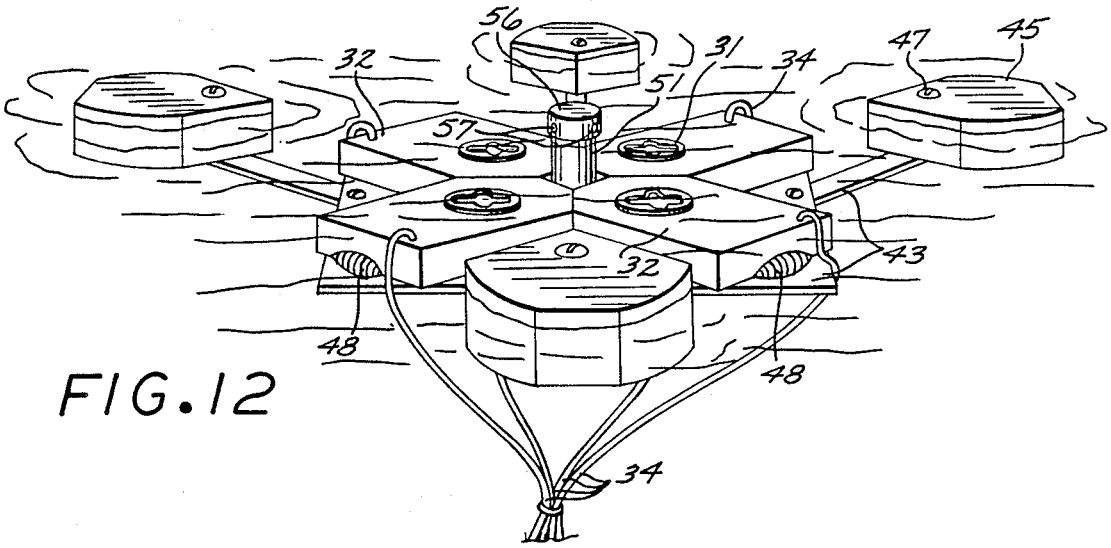
FIG. 12 is a perspective view of a preferred embodiment of the present invention.
Figure 13:
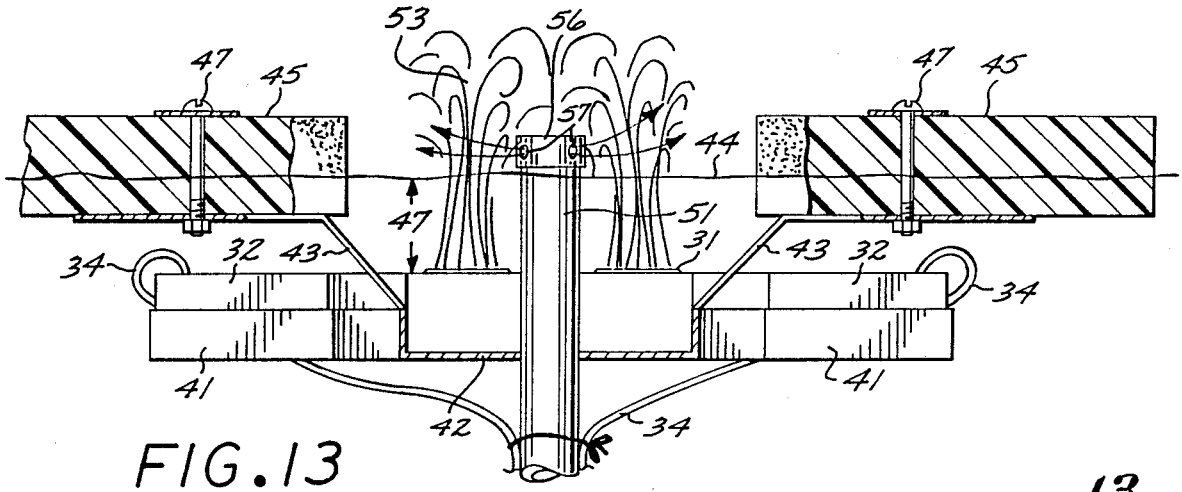
FIG. 13 is a cross-section of FIG. 12.
Figure 14:
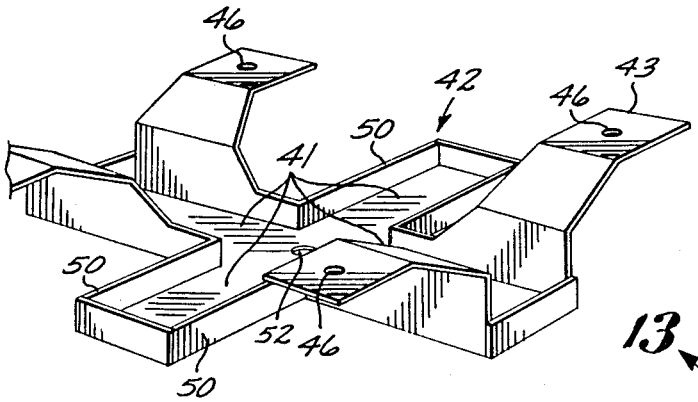
FIG. 14 is a perspective view of a frame employed in a preferred embodiment of the present invention.
Figure 15:
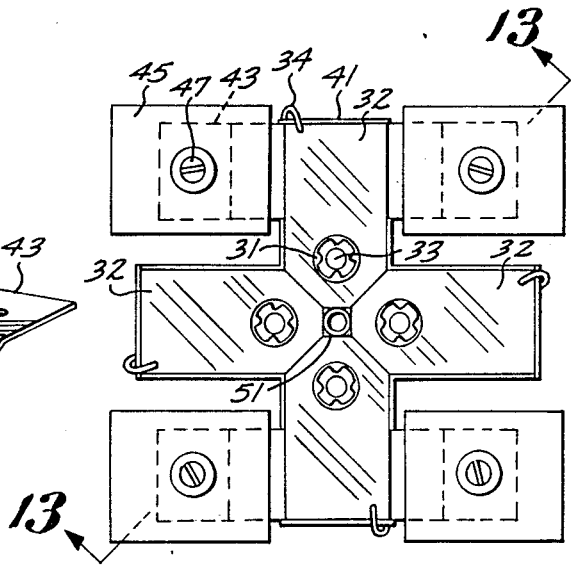
FIG. 15 is a top plan view of the fog producing apparatus of the present invention illustrated in perspective in FIG. 12.

In operation, an ultrasonic transducer is capable of atomizing a liquid visible as plumes of fog or mist at the surface of the liquid beneath which the transducer is disposed. Parenthetically, it has been found that the ultrasonic energy responsible for this effect can transfer through other mediums such as the bottom of a partially filled cup as illustrated in FIG. 11 The partially filled cup 54 is partially submerged above the transducer 31 of a submerged potted transducer module 32. Upon activation of the transducer a fog plume is generated on the surface of the liquid 56 within the cup 54. The potting of the ultrasonic transducer modules of the present invention imparts a degree of versatility to their use which has not been heretofore attained.

In the embodiment illustrated in FIGS. 9 and 10 the potted ultrasonic transducers placed beneath the water's surface within the tray each emit a plume of fog or mist. As the water level 40 drops due to either leakage from the tray, or by the atomizing effect of the transducers, the float 38 descends and causes valve 39 to emit more water into the tray. When the desired water level has once again been achieved, the position of the float causes the valve 39 to shut off the flow of water. The individual encapsulation of the ultrasonic transducers in the potting material effectively prevents water damage from cutting short the expected service life of the transducer. Should a particular transducer need replacement, it can simply be lifted out of the tray and replaced. The fog-producing apparatus can be quickly returned to full operation, as no disassembly or draining of the water is required, indeed the operational transducers need not be shut down while a faulty transducer is being replaced. In addition, a manifold cover similar to the one 23 depicted in FIGS. 1 and 2 can be fitted through which air is blown to collect the generated fog and conduct it to a remote location.

The apparatus illustrated in FIGS. 12–15 functions in the same manner, with the added improvement that the water level need not be monitored or precisely maintained. The floating arrangement automatically serves to maintain a predetermined amount of water over each transducer regardless of the total water depth. In addition, the presence of the float members 45 about the periphery of the apparatus serve to divert waves or surface disturbances to further stabilize the precise level of water maintained over the transducer. The carrier frame 42 of FIGS. 13–15 allows replacement of a defective module in short order without interrupting the operation of the other modules, as each module is simply cradled within the frame. The air flow emanating from the airpipe 51 serves to dissipate the individual fog plumes 53 to create a more homogeneous fog effect. In this embodiment the fog-producing apparatus can be placed into any reservoir of water and freely moved about even while in operation and is unaffected by the overall water depth and wave action.

Many modifications and variations of the present invention are possible in light of the above teachings and it is therefore to be understood that within the scope of the appended claims the invention may be practiced otherwise than as specifically described.

What is claimed is:

1. An apparatus for producing fog, comprising an ultrasonic transducer module, said module including a transducer disc and circuitry means for oscillating said disc in the MHz frequency range, potted in an electrically insulative and water-proof potting material whereby only said disc remains exposed so that the entire module is submersible and functional within a body of water.

2. The apparatus of claim 1 wherein the potting material further comprises a material that does not substantially expand, contract or heat-up while solidifying.

3. The apparatus of claim 2 wherein the potting material comprises a urethane.

4. The apparatus of claim 2 wherein the potting material comprises a silicon compound.

5. The apparatus of claim 2 wherein the potting material comprises an epoxy.

6. The apparatus of claim 1 further comprising:

a housing for containing water and for supporting said potted transducer module so as to be completely submerged within said water; and, a means for maintaining a predetermined water level within said housing.

7. The apparatus of claim 6 wherein said means for maintaining a predetermined level of water comprises a float actuated inlet valve wherein said float floats on the water's surface and causes said valve to admit more water into said housing when floating below a predetermined level and causes said valve to shut off any flow of water to the housing when floating at or above a predetermined level.

8. The apparatus of claim 7 further comprising a manifold, covering said housing and affixed thereto above the predetermined water level, for collecting fog produced by said potted transducer module and conducting it to a remote location.

9. The apparatus of claim 1 further comprising:

a float means capable of imparting a positive buoyancy to the potted transducer module within water; and, a means for suspending said potted transducer a predetermined distance below the water surface.

10. The apparatus of claim 9 wherein said suspending means comprising a frame member configured to support said potted transducer, having upwardly extending arms capable of receiving said float means.

11. The apparatus of claim 10 further comprising an airpipe having a discharge end supported by said frame member so as to project just above the water level and plumbed to a compressed air source whereby fog produced by said potted transducer module is dispersed by air flow issuing from said airpipe.

12. The apparatus of claim 10 wherein said float means are configured so as to substantially surround the submerged transducer module whereby an area above the transducer disc is shielded from wave action on the water surface and a substantially uniform depth of water is thereby maintained over said transducer disc.

13. An apparatus for producing fog comprising a plurality of potted ultrasonic transducer modules potted in an electrically insulative and waterproof potting material, suspended a predetermined distance below a body of water's surface by attachment to a plurality of floats capable of imparting a positive buoyancy to the entire apparatus within said body of water and arranged so as to shield an area above said transducers from any wave action said body of water is subject to.

14. The apparatus of claim 13 further comprising an airtube plumbed to a remote source of compressed air and having a discharge end, disposed amidst said transducers, projecting to just above the water surface for dispersing fog produced by said potted transducer modules.

* * * * *